US007137415B2

(12) United States Patent
Olbing et al.

(10) Patent No.: US 7,137,415 B2
(45) Date of Patent: Nov. 21, 2006

(54) HEDDLE SHAFT WITH CENTER CONNECTOR

(75) Inventors: Andre Olbing, Raesfeld (DE); Karl-Heinz Gesing, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/968,091

(22) Filed: Oct. 20, 2004

(65) Prior Publication Data

US 2005/0081943 A1 Apr. 21, 2005

(30) Foreign Application Priority Data

Oct. 21, 2003 (DE) ..... 103 49 383

(51) Int. Cl.
*D03C 9/06* (2006.01)
*D03C 13/00* (2006.01)

(52) U.S. Cl. ..... 139/82; 139/88; 139/91; 139/92

(58) Field of Classification Search ..... 139/82, 139/88, 91, 92
See application file for complete search history.

(56) References Cited

U.S. PATENT DOCUMENTS

| | | | | |
|---|---|---|---|---|
| 2,944,571 | A * | 7/1960 | Pfarrwaller | 139/91 |
| 3,335,759 | A | 8/1967 | Koch | |
| 3,352,329 | A * | 11/1967 | Koch | 139/92 |
| 3,434,505 | A * | 3/1969 | Koch | 139/92 |
| 3,874,419 | A * | 4/1975 | Wagner | 139/91 |
| 3,889,721 | A * | 6/1975 | Wagner | 139/91 |
| 3,948,296 | A * | 4/1976 | Koch | 139/91 |
| 3,960,182 | A * | 6/1976 | Schwarz | 139/91 |
| 3,970,114 | A * | 7/1976 | Baumann | 139/91 |
| 4,112,980 | A | 9/1978 | Bader | |
| 4,227,553 | A * | 10/1980 | Schwarz | 139/82 |
| 4,741,367 | A | 5/1988 | Kitawaki | |
| 5,139,053 | A * | 8/1992 | Yokoi | 139/82 |
| 5,332,006 | A * | 7/1994 | Gaisser | 139/91 |
| 5,351,719 | A | 10/1994 | Graf | |
| 5,887,629 | A | 3/1999 | Mettler et al. | |

FOREIGN PATENT DOCUMENTS

| | | |
|---|---|---|
| CH | 547 366 | 3/1974 |
| DE | 1 083 759 | 6/1960 |
| DE | 1 109 619 | 6/1961 |
| DE | 1 131 606 | 6/1962 |
| DE | 1 265 675 | 4/1968 |
| DE | 20 20 778 | 7/1978 |
| DE | 78 38 642 U1 | 3/1979 |
| DE | GM 78 38 642 | 3/1979 |
| DE | 32 20 710 C2 | 4/1986 |
| EP | 0 533 600 A1 | 3/1993 |

* cited by examiner

*Primary Examiner*—Gary L. Welch
*Assistant Examiner*—Robert Muromoto
(74) *Attorney, Agent, or Firm*—Norman N. Kunitz; Fitch, Even, Tabin & Flannery

(57) ABSTRACT

A heddle shaft (1) has shaft rods (2, 3), which are embodied as profile bodies (12) having at least one hollow chamber (14). The shaft rods (2, 3) are joined together by lateral bracing posts (4, 5) and at least one center connector (11). For securing the latter, retaining pieces (23) are disposed in the hollow chambers and are accessible through windows (22). The retaining pieces (23) are preferably glued into the hollow chamber (14) and have one or more threaded bores for securing the center connector (11) by means of screws (37).

13 Claims, 2 Drawing Sheets

HEDDLE SHAFT WITH CENTER CONNECTOR

CROSS REFERENCE TO RELATED APPLICATION

This application claims the priority of German Patent Application No. 103 49 383.2, filed on Oct. 21, 2003, the subject matter of which, in its entirety, is incorporated herein by reference.

FIELD OF THE INVENTION

The invention relates to a heddle shaft which is suitable for power looms, especially high-speed power looms.

BACKGROUND OF THE INVENTION

So-called heddle shafts are used for shedding in power looms. The heddle shafts are formed by a frame that is essentially rectangular in a front elevation view and whose upper and lower long, longitudinal edges are each formed by one shaft rod. Laterally, the shaft rods are joined by lateral bracing posts. The shaft rods are often formed by hollow chamber profiles. Heddle support rails that support the heddles are secured to the shaft rods. Each heddle has at least one yarn eyelet, through which a warp thread is guided. For shedding, the heddle shafts are moved up and down in rapid succession. For wide weaving widths, the result is very long shaft rods, which tend to sagging, as a function of the weaving speed (number of revolutions). To reduce such sagging and above all to avoid different sagging of different shaft rods, besides the lateral bracing posts, center connectors are occasionally used to join the shaft rods together. Such center connectors are struts that with their ends join the two shaft rods.

For instance, a heddle shaft with this kind of center connector is known from German Published, Examined Patent Disclosure DE-AS 26 20 778. The shaft rod comprises sheet-metal profiles, with a filler core between them, for instance of hard plastic foam, honeycomblike material, or a lightweight type of wood. The filler material is glued to the sheet-metal profiles. In order also to create a possible way of inserting the center connector, a free space between the sheet-metal profiles is filled with a rubber body, which is joined in firmly adhering fashion, for instance glued, to the flat sheet-metal profiles. An extension of a profile rail is retained in the rubber body, and with a widened head, this extension retains a so-called slide element that is also thrust into the interstice between the two sheet-metal profiles. Screws are inserted into this slide element and hold the center connector, here called an intermediate strut.

From Swiss Patent CH 547 366, a heddle shaft with an adjustable center connector is also known. Here the heddle shaft is formed by a hollow chamber profile, which in the region of the center connector may have a window oriented toward the respective other shaft rod. A retaining piece is disposed in the interior of the hollow chamber profile and is joined to the side walls of the hollow chamber profile.

This arrangement is not optimized for maximum weaving speeds.

From German Patent DE 32 20 710 C2, a heddle shaft is known with shaft rods which each, on their respective side toward the heddle support rail, have a narrow chamber for receiving a clamping piece. The chamber is accessible toward the heddle support rail through a window. A clamping piece inserted into the chamber acts here as an abutment for the center connector.

The transmission of force between the center connector and the shaft rod takes place in a relatively small space. Moreover, the embodiment of a longitudinally continuous chamber for the clamping piece requires increased consumption of material and thus results in a considerable mass for the shaft rod.

A shaft rod also embodied as a hollow profile is found in German Patent DBP 1083759. For attaching a plurality of center connectors, each shaft rod is provided, on its opening toward the heddle support rail, with an opening through which a suitable retaining piece disposed in the interior is accessible. The retaining piece has threaded bores for receiving screws, which retain the center connector.

With this as the point of departure, it is the object of the invention to create a heddle shaft which is especially suitable for high-speed power looms.

SUMMARY OF THE INVENTION

This object is generally attained with the heddle shaft of the invention having a shaft rod, which is embodied or formed as a hollow chamber profile body and has at least one but preferably two or more closed hollow chambers, which extend longitudinally through the shaft rod. The hollow chambers preferably have a cross section that does not change longitudinally. The cross sections of the individual hollow chambers are preferably approximately of equal size. If needed, they may also be embodied in different sizes, in which case stems provided between the flat side walls are disposed from the standpoint of rigidity. The hollow chambers preferably have an approximately rectangular cross section, and the hollow chamber toward the heddle support rail is provided with a window at a point where a center connector is to be disposed. Through this window, a retaining piece disposed in the hollow chamber and joined two-dimensionally to the side walls that define the hollow chamber is accessible. Because of the two-dimensional connection, a large-area transmission of force takes place between a center connector, which can be attached to the retaining piece, and the shaft rod. It is therefore possible to use hollow chamber profiles with very thin side walls.

The invention makes it possible to provide wide heddle shafts with long shaft rods, and these heddle shafts are suitable for high weaving speeds. No separate chamber for clamping pieces or the like for securing center connectors is needed. Very lightweight shaft rods, which are intrinsically not intended for constructing heddle shafts with center connectors, can therefore be used. Hence the corresponding hollow chamber profile bodies can be cut to the proper length from an endless profile from which normally only shorter shaft rods are made.

The hollow chamber intended for receiving the retaining piece is preferably a hollow chamber that receives corner connector pieces at the ends of the shaft rod. A separate hollow chamber for receiving the retaining piece is unnecessary. Preferably, the cross section of the retaining piece fills the cross section of the hollow chamber substantially without gaps. In particular, it is considered advantageous if the retaining piece touches both side walls and both stems. It can thus be braced on all sides in the hollow chamber.

Securing the retaining piece in the hollow chamber is preferably done by means of an adhesive connection; it is preferable that the retaining piece be seated in the hollow chamber with only little play, while the adhesive is not yet hardened. This makes it possible to position the retaining piece in the hollow chamber, introduce adhesive, and process or manipulate the applicable shaft rod further without taking particular consideration of the adhesive connection, which may not yet be capable of withstanding a load.

Moreover, it is considered advantageous if the retaining piece spans the window, provided for attaching the center connector, in the longitudinal direction of the shaft. Thus the weak point in the shaft rod created by the retaining window is closed with regard to its bending strength. Given a suitable overlap, the rigidity of the shaft rod in the region of the window can even be increased beyond the otherwise existing amount.

It is considered advantageous to provide the shaft rod and/or the retaining piece with a means that facilitates the introduction of adhesive. Such a means may comprise one or more conduits, which are embodied in the retaining piece and/or in the shaft rod and by way of which the adhesive can be introduced into the desired adhesive seam from outside. Such conduits may be formed for instance by one or more transverse bores of the retaining piece, which communicate with one or more adhesive introduction openings provided in the side walls of the shaft rod. The retaining piece preferably has at least one adhesive pocket, which can store a certain quantity of adhesive so that from this reserve, the adhesive seam to be formed can be supplied with adhesive.

The retaining piece may be a plastic body or a metal body or a combined plastic and metal body. For instance, threaded bushes can be embedded in a plastic body, as a result of which the retaining piece is on the one hand lightweight and rigid and on the other is suitable for sturdy attachment of the center connector by means of screws.

Further details of advantageous embodiments of the invention are the subject of the drawings, description or claims.

BRIEF DESCRIPTION OF THE DRAWINGS

In the drawing, exemplary embodiments of the invention are shown.

DETAILED DESCRIPTION OF THE INVENTION

Figure 1:
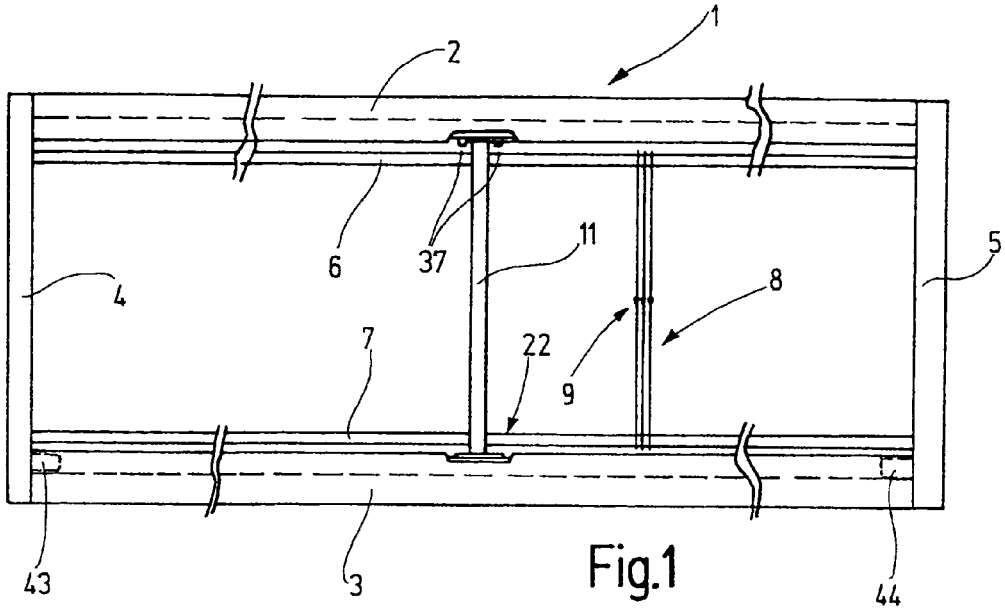
FIG. 1 is a schematic, shortened front elevation view of a heddle shaft provided with a center connector.

In FIG. 1, a heddle shaft 1 is shown which has an upper shaft rod 2, a lower shaft rod 3, and lateral bracing posts 4, 5. The shaft rods 2, 3, kept spaced apart and parallel, together with the lateral bracing posts 4, 5 form a rectangular frame. One heddle support rail 6, 7 is retained on each shaft rod 2, 3, and between these rails a large number of heddles 8 are retained. Each of the heddles 8 has at least one yarn eyelet 9, through which a warp thread is guided. In the up-and-down motion of the heddle shaft 1, this warp thread is moved up or down to form sheds.

The shaft rods 2, 3 are joined together between their lateral bracing posts by one or more center connectors 11 extending approximately parallel to the lateral bracing posts 4, 5. The center connectors 11 may be provided in the middle between the lateral bracing posts 4, 5 and/or additionally at other points, and they extend parallel to the lateral bracing posts 4, 5. They serve to suppress or damp uncontrolled oscillations of the shaft rods 2, 3 in the operation of the power loom enough that the heddles 8 and other parts of the heddle shaft 1 suffer no damage.

Figure 2:
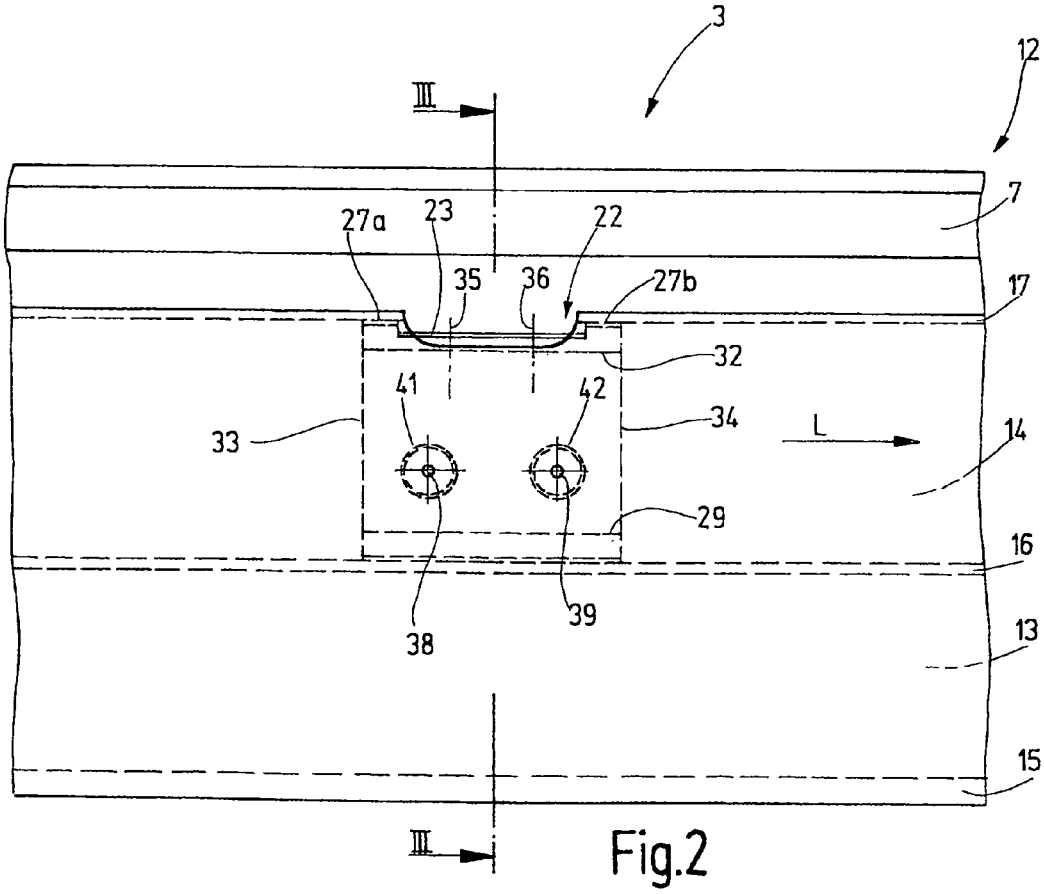
FIG. 2 is a detail of a shaft rod of the heddle shaft of FIG. 1.
Figure 3:
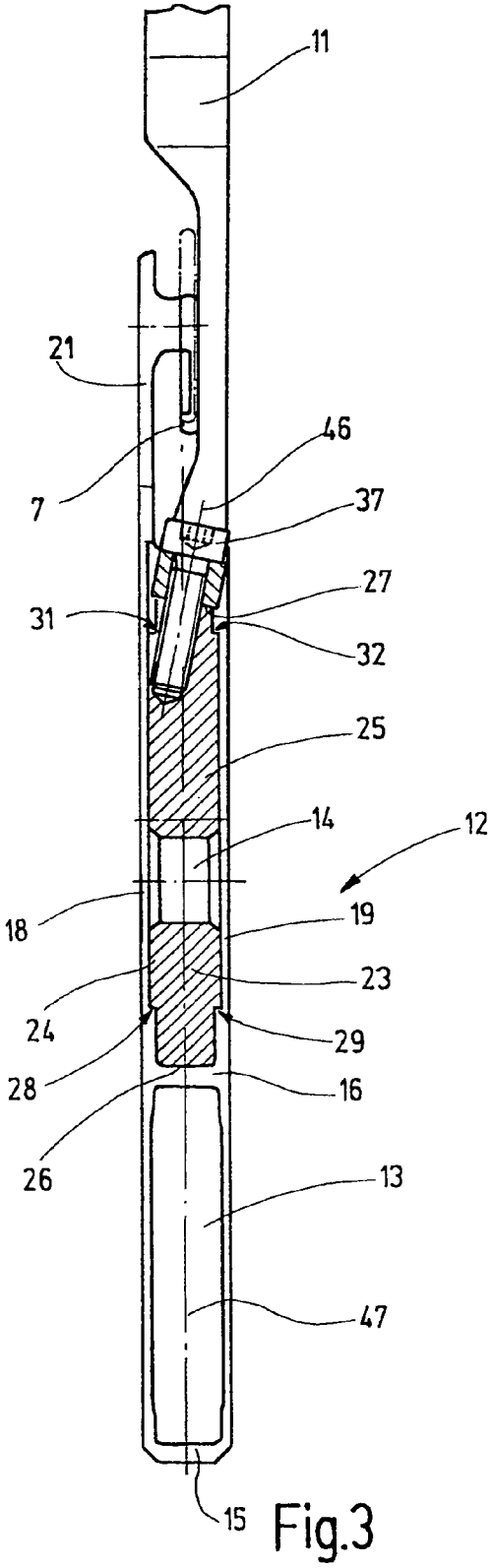
FIG. 3 is a section through the shaft rod of FIG. 2 taken along the line III—III.

The shaft rods 2, 3 are embodied substantially identically or similarly to one another. The ensuing description of the shaft rod 3 therefore applies accordingly to the shaft rod 2:

The shaft rod 3 is shown separately and in section in FIG. 2. It is formed essentially by a profile body 12, for instance in the form of a lightweight metal extruded profile. Its cross section is unchanged along its longitudinal direction L. In the present exemplary embodiments the profile body 12, as FIG. 3 particularly also shows, has two hollow chambers 13, 14, of which at least the hollow chamber 14 oriented toward the heddle support rail 7 is empty. The hollow chamber 13 may also be empty or may also be filled as needed with a filler material, such as a lightweight foam or the like. Hollow chamber profiles with only one hollow chamber or with a plurality of hollow chambers may also be employed. The hollow chambers 13, 14 preferably have an approximately rectangular cross section. The hollow chamber 13 is defined by an outer stem or web 15 and by a stem or web 16 that divides the two hollow chambers 13, 14 from one another. The hollow chamber 14 is defined by the stem 16 and by the stem 17 (see FIG. 2), disposed parallel to it, in the direction toward the heddle support rail 7. The stems are oriented parallel to one another and have approximately the same thickness. Approximately perpendicular to the stems, the profile body 12 has side walls 18, 19 which are preferably substantially thinner than the stems 15, 16, 17 and which form the flat sides of the profile body 12. Immediately next to the stems 15, 16, 17, the side walls 18, 19 may have an increased thickness, so that they then at a spacing from the respective stem 15, 16, 17, they change over via a shoulder or a chamfer 28, 29 to a thinner region of the side walls. The profile body 12 is a profile that is largely optimized for the sake of bending strength. One wall region 21 begins at the side wall 18 and extends away from the stem 17 (FIG. 3). The wall region 21 supports the heddle support rail 7.

Wherever a center connector 11 is to be disposed, a window 22 is embodied on the shaft rod 3. The window 22 is formed by an opening that removes the stem 17 over its entire width between the side walls 18 and 19, along with a slight portion of the side wall 19. Through the window 22, a retaining piece 23 that is disposed in the hollow chamber 14 is accessible. The retaining piece 23 can be seen in FIGS. 2 and 3. In its simplest form, it is an approximately block-shaped element of metal or plastic. It may for instance be embodied of an expanded metal (such as aluminum foam) or it may be formed by a solid metal body or plastic body. It has two flat sides 24, 25, which rest substantially over their entire surface on the side walls 18, 19. In the vicinity of the narrow upper and lower face ends 26, 27 of the retaining piece 23, the retaining piece 23 may be provided with shoulders 28, 29, 31, 32, for receiving what here are thickened portions of the side walls 18, 19. The height of the retaining piece 23 is dimensioned such that the face ends 26, 27 rest on the stems 16, 17. The length of the retaining piece 23 to be measured between its two end faces 33, 34 is preferably greater than the length, also to be measured in the longitudinal direction L of the window 22, so that the window is spanned by the retaining piece 23. Correspondingly, portions 27*a*, 27*b* on both sides of the window 22 rest on the stem 17.

In the region of the window 22, the retaining piece 23 has at least one but preferably two or more threaded bores 35, 36, which are indicated in FIG. 2 only by dot-dash lines. They serve to receive fastening screws 37, with which the center connector 11 can be attached to the retaining piece 23.

The center connector is embodied as a rod that has a foot on both ends and connects the shaft rods 2, 3 together like a strut.

In a simplest embodiment, the retaining piece 23 can be seated loosely, that is, with little play, in the hollow chamber 14. However, it is preferable to secure the retaining piece in place, for instance with adhesive, and additionally to bring about a reinforcement of the shaft rod 3, which is weakened by the window 22, in the region of the window 22. To that end, adhesive is introduced at least between the flat sides 24, 25 and the respective adjacent side walls 18, 19, and the adhesive extends as much as possible from one end face 33 to the other end face 34. It also preferably extends over at least the region of a respective flat side 24, 25 that is enclosed between the shoulders 28, 29, 31, 32 respectively belonging to that flat side. In a further-preferred embodiment, the face ends 26, 27 of the retaining piece 23 are also glued to the struts 16, 17.

For introducing the adhesive, the side wall 18 and 19 may be provided with one or more adhesive introduction openings, for instance in the form of relatively small holes 38, 39, which serve as means for introducing adhesive between the respective side wall 18, 19 and the retaining piece 23. In the region of the holes 38, 39, the retaining piece 23 is preferably provided with through bores 41, 42, whose diameter is substantially greater than the diameter of the holes 38, 39. Thus they form adhesive pockets on the one hand, and on the other they are independent of the precise axial positioning of the retaining piece 23, at least far enough in the region of the holes 38, 39 that they can fill with adhesive.

The retaining piece 23 can also be joined to the side walls 18, 19 by other fastening techniques than adhesive bonding. In shaft rods 2, 3 that are made of composite materials, and whose side walls 18, 19 are of sheet steel, for instance, the retaining piece 23 may be welded to the side walls 18, 19. It is also possible for the retaining piece 23 to be joined to the side walls 18, 19 by means of a rivet or screw connection or connections.

For constructing a heddle shaft 1, the shaft rods 2, 3 are first provided with windows 22 at the points where the center connectors 11 are to be provided. If necessary, the heddle support rails 6, 7 are secured. The required retaining pieces 23 are then axially thrust into the hollow chamber 14. The play of the retaining pieces 23, which substantially fill the cross section of the hollow chamber 14, is precisely large enough that the retaining pieces 23 can be slid into their place, where they close the respective window 22, without excessive effort. Prior to or at this present instant, the holes 38, 39 are then made in the side wall 19, and adhesive is introduced through these holes 38, 39. This can be done by exerting pressure, to promote feeding of the adhesive into the gap between the flat sides 24, 25 and the side walls 18, 19. Depending on the adhesive used, the shaft rod 2, 3 can be heated for the purpose. This is especially true if hot-melt adhesives are used. Adhesives that in a sense draw into the adhesive seam on their own by capillary action may also be employed.

A corner connector 43, 44 (FIG. 1) is inserted into the hollow chamber 13 and/or the hollow chamber 14 on both ends of the shaft rod 2, 3 and, if necessary, secured. The heddle shaft 1 can now be installed. Once the heddles 8 have been slipped onto the heddle support rails 6, 7, the center connector or connectors 11 can be screwed between the shaft rods 2, 3.

Figure 4:
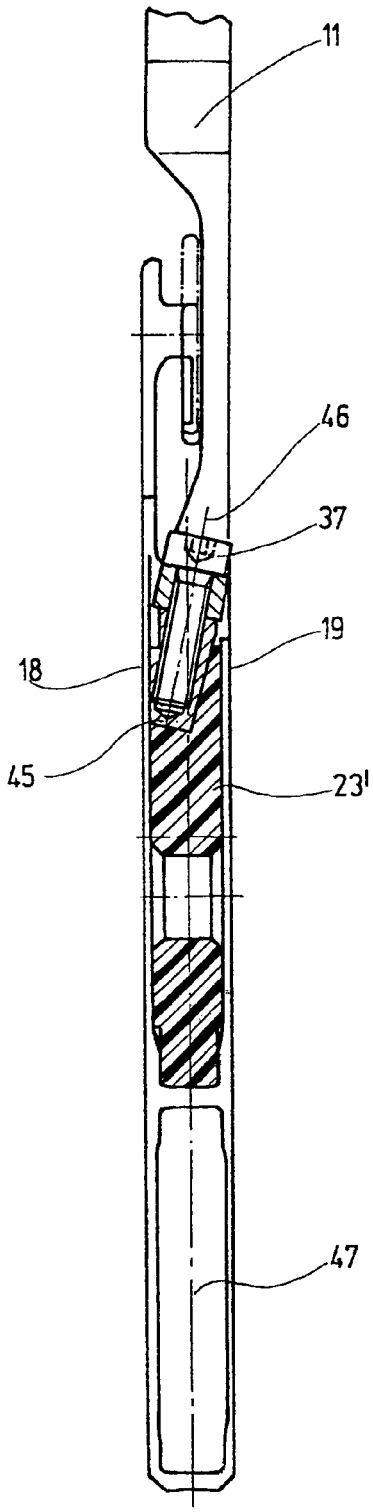
FIG. 4 is a sectional view corresponding to FIG. 3 through a modified embodiment of the shaft rod of FIG. 2.

FIG. 4 illustrates a modified embodiment of the shaft rod 3, which differs from the embodiment described above by the altered embodiment of the retaining piece 23'. The retaining piece 23' is formed by a plastic body, in which one or more threaded bushes 45, preferably of metal, are disposed in order to receive the fastening screws 37. The threaded bushes, like the corresponding threaded bores 35, 36, have an orientation that is inclined relative to the side walls 18, 19. Thus the bore axes 46 and the longitudinal direction of the center connector 11, which is marked in FIGS. 3 and 4 by a dot-dash line 47 extending parallel to the side walls 18, 19, form an acute angle. This makes access to the fastening screws 37 easier upon loosening and securing of the center connector 11. This is necessary, for setting up the heddle shaft 1, for instance whenever heddles on the heddle support rails 6, 7 must be displaced past the position of the center connector 11 or require replacement.

A heddle shaft 1 has shaft rods 2, 3, which are embodied as profile bodies 12 having at least one hollow chamber 14. The shaft rods 2, 3 are joined together by lateral bracing posts 4, 5 and at least one center connector 11. For securing the latter, retaining pieces 23 are disposed in the hollow chambers and are accessible through windows 22. The retaining pieces 23 are preferably glued into the hollow chamber 14 and have one or more threaded bores for securing the center connector 11 by means of screws 37.

It will be appreciated that the above description of the present invention is susceptible to various modifications, changes and adaptations, and the same are intended to be comprehended within the meaning and range of equivalents of the appended claims.

List of Reference Numerals:

| | |
|---|---|
| 1 | Heddle shaft |
| 2, 3 | Shaft rod |
| 4, 5 | Lateral bracing post |
| 6, 7 | Heddle support rail |
| 8 | Heddles |
| 9 | Yarn eyelet |
| 11 | Center connector |
| 12 | Profile body |
| 13, 14 | Hollow chamber |
| 15, 16, 17 | Stem |
| 18, 19 | Side walls |
| 21 | Wall region |
| 22 | Window |
| 23 | Retaining piece |
| 24, 25 | Flat sides |
| 26, 27 | Face ends |
| 28, 29, 31, 32 | Shoulders |
| 33, 34 | End faces |
| 35, 36 | Threaded bores |
| 37 | Fastening screws |
| 38, 39 | Adhesive introduction openings/holes |
| 41, 42 | Through bores |
| 43, 44 | Corner connectors |
| 45 | Threaded bushes |
| 46 | Bore axes |
| 47 | Line |
| L | Longitudinal direction |

What is claimed is:

1. A heddle shaft for high-speed power looms, having:

a shaft rod, which is embodied as a hollow chamber profile body that has at least one closed hollow chamber with two substantially flat side walls and two stems, one of which is provided with a window; and, a retaining piece, which is disposed in the hollow chamber and is joined two-dimensionally to the side walls; and wherein the shaft rod is provided with a means for introducing adhesive between the side wall and the retaining piece.

2. The heddle shaft of claim 1, wherein the means is a conduit provided in at least one of the side walls.

3. The heddle shaft of claim 2, wherein the means further includes an adhesive pocket formed in the retaining piece and aligned with the conduit.

4. A heddle shaft rod, in particular for high-speed power looms, comprising:

a hollow chamber profile body that has two substantially flat side walls and two transverse stems connecting the sidewalls to define at least one closed hollow chamber, with one of the stems being provided with a window; and, a retaining piece, which is disposed in the hollow chamber, spans the window in the longitudinal direction of the shaft rod, is joined two-dimensionally to both side walls via an adhesive, and extends, within the chamber, from one stem to the other stem.

5. The heddle shaft rod of claim 4, wherein the retaining piece has at least one threaded bore, which is accessible through the window, for the direct connection of an intermediate strut.

6. A heddle shaft comprising: a pair of spaced shaft rods as defined in claim 4: a pair of side struts connecting respective ends of the shaft rods together, with the windows of the respective rods facing one another; and an intermediate strut having its respective ends directly connected to a respective retaining piece of the shaft rods.

7. The heddle shaft of claim 4, wherein the hollow chamber has a height, to be measured between the stems, that is greater than the width to be measured between its side walls.

8. The heddle shaft of claim 4, wherein the hollow chamber, on its face ends, is provided with corner connector pieces, to which the lateral bracing posts are connected.

9. The heddle shaft of claim 4, wherein the retaining piece fills the entire cross section of the hollow chamber.

10. The heddle shaft of claim 4, wherein the retaining piece has at least one adhesive pocket.

11. The heddle shaft of claim 4, wherein the retaining piece is a plastic body having at least one metal inlay.

12. The heddle shaft of claim 4, wherein the retaining piece rests on both stems.

13. The heddle shaft of claim 4, wherein the retaining piece, with each side wall, defines an adhesive seam which exceeds the length of the window in the longitudinal direction (L) of the shaft rod and spans the window.

* * * * *